US010709231B2

(12) United States Patent
Macomber

(10) Patent No.: US 10,709,231 B2
(45) Date of Patent: Jul. 14, 2020

(54) ROTARY SCRUBBER

(71) Applicant: Lance Richard Macomber, Burlington, VT (US)

(72) Inventor: Lance Richard Macomber, Burlington, VT (US)

( * ) Notice: Subject to any disclaimer, the term of this patent is extended or adjusted under 35 U.S.C. 154(b) by 21 days.

(21) Appl. No.: 16/046,568

(22) Filed: Jul. 26, 2018

(65) Prior Publication Data

US 2019/0029410 A1 Jan. 31, 2019

Related U.S. Application Data

(60) Provisional application No. 62/537,081, filed on Jul. 26, 2017.

(51) Int. Cl.
*A46B 13/08* (2006.01)
*B08B 9/087* (2006.01)
(Continued)

(52) U.S. Cl.
CPC ..... *A46B 13/08* (2013.01); *A47L 17/00* (2013.01); *A47L 17/04* (2013.01); *B08B 9/087* (2013.01); *A46B 2200/3006* (2013.01)

(58) Field of Classification Search
CPC .... A46B 5/00; A46B 7/00; A46B 7/06; A46B 7/08; A46B 7/10; A46B 11/00; A46B 11/002; A46B 11/0055; A46B 11/08; A46B 13/00; A46B 13/001–006; A46B 13/08; A46B 13/026; A46B 17/06; A46B 17/065; A46B 2200/3033; A46B 2200/3006; A46B 2200/3013; A46B 2200/304; A47L 13/00; A47L 13/10; A47L 17/00; A47L 17/04;
(Continued)

(56) References Cited

U.S. PATENT DOCUMENTS 1,921,509 A * 8/1933 De Forest ..... A47L 15/0068 15/76
2,398,231 A * 4/1946 Kott ..... B23B 45/06 74/89.45
(Continued)

OTHER PUBLICATIONS

Nicholas Giordano, "College Physics: Reasoning and Relationships," at 352-53 (Brooks/Cole 2010). (Year: 2010).*

*Primary Examiner* — Mikhail Kornakov
*Assistant Examiner* — Richard Z. Zhang
(74) *Attorney, Agent, or Firm* — Heslin Rothenberg Farley & Mesiti P.C.; Kristian E. Ziegler, Esq.

(57) ABSTRACT

A rotary scrubber apparatus, the apparatus includes a tube member having a helical slot, an attachment end portion, a holding end portion, and an internal cavity extending therethrough. A biasing element is contained within the internal cavity of the tube member. A following pin extends through the helical slot. The following pin has an external portion that engages a handle, and an internal portion that engages the biasing element. A scrubbing element is coupled with the attachment end of the tube member and rotationally fixed therewith. When the handle is pressed towards the attachment end and the handle is prevented from rotating about the tube member, the tube member rotates to rotate the scrubber element. The apparatus thereby provides rotational movement of the scrubber to be generated from only linear movement of the handle provided by a user.

17 Claims, 7 Drawing Sheets

(51) Int. Cl.
*A47L 17/00* (2006.01)
*A47L 17/04* (2006.01)

(58) Field of Classification Search
CPC ..... A47L 15/0068; A47L 15/37; A47L 15/39; A47K 11/10; A47K 7/03; A47K 5/14; B08B 1/00; B08B 1/02; B08B 1/04; B08B 1/002; B08B 3/00; B08B 3/02; B08B 3/06; B08B 3/08; B08B 9/02; B08B 9/027; B08B 9/032; B08B 9/04; B08B 9/0436; B08B 9/20; B08B 9/045; B08B 9/08; B08B 9/0808; B08B 9/0813; B08B 9/087; B08B 9/093; B08B 9/36; B05C 1/00; B05C 1/08; B05C 11/02; B05C 11/025; B05C 17/10; B05C 17/0136; B05D 1/28; B05D 2203/35; B23B 45/00; B23B 45/06; B25B 15/06
USPC ..... 15/25, 65, 164, 213
See application file for complete search history.

(56) References Cited

U.S. PATENT DOCUMENTS 2,571,902 A * 10/1951 Lever ..... A47L 15/0068 15/76
2,636,393 A * 4/1953 Josephs ..... A46B 13/08 74/89.45
2,866,215 A * 12/1958 Scully ..... A47L 17/00 15/145
5,181,668 A * 1/1993 Tsuji ..... B08B 9/045 118/317

* cited by examiner

ROTARY SCRUBBER

CROSS REFERENCE TO RELATED APPLICATION

This application is a U.S. Non-provisional Patent Application which claims priority to U.S. Provisional Patent Application No. 62/537,081, filed on Jul. 26, 2017, the entirety of which is hereby incorporated herein by reference.

FIELD OF DISCLOSURE

The present invention generally relates to a handheld apparatus for cleaning bottles, drinking glasses and similar containers, and more particularly to handheld container cleaning apparatus that provide rotary motion of a scrubber within the container.

BACKGROUND

Efficient cleaning within a container having an opening leading to a relatively deep containment volume can be difficult. If the opening is of a size that prevents one's hand from reaching within the containment volume, manual movement of a sponge or brush on an end of a relatively long handle is the standard cleaning mode. Although back and forth movement along the length of the cleaning implement is fairly easy, rotational movement of the device, and therefore the sponge or brush, is difficult because of the limited rotational movement of the user's hands/arms. Because of this, it is especially difficult to clean the bottom area of a container where the sides thereof meet a base or bottom portion.

The present disclosure provides a container cleaning apparatus that provides enhanced rotational movement of a scrubber portion using simple linear movement of a user's hand(s).

In this specification, where a document, act or item of knowledge is referred to or discussed, this reference or discussion is not an admission that the document, act or item of knowledge or any combination thereof was, at the priority date, publicly available, known to the public, part of common general knowledge, or otherwise constitutes prior art under the applicable statutory provisions; or is known to be relevant to an attempt to solve any problem with which this specification is concerned.

SUMMARY

Briefly, the present inventions satisfy the need for improved container cleaning apparatus. The present inventions may address one or more of the problems and deficiencies of the art discussed above. However, it is contemplated that the inventions may prove useful in addressing other problems and deficiencies in a number of technical areas. Therefore, the claimed inventions should not necessarily be construed as limited to addressing any of the particular problems or deficiencies discussed herein.

Certain embodiments of the presently-disclosed insulation and/or fill materials, articles comprising the materials, and methods for forming the materials have several features, no single one of which is solely responsible for their desirable attributes. Without limiting the scope of the insulation and/or fill materials, articles and methods as defined by the claims that follow, their more prominent features will now be discussed briefly. After considering this discussion, and particularly after reading the section of this specification entitled "Detailed Description," one will understand how the features of the various embodiments disclosed herein provide a number of advantages over the current state of the art.

In one aspect, the present disclosure is directed to an apparatus for cleaning a container. The apparatus comprises a tube having a wall that defines an interior, an exterior, an attachment end and a holding end. The tube has a helical slot passing from the exterior to the interior along a portion of the length of the tube. A following pin moves along the helical slot. The following pin extends from the exterior to the interior. The following pin has an external end engaged with a handle and an internal end extending to the tube interior. A biasing element is contained within the tube interior. The biasing element extends from said attachment end to the following pin. A bias engagement element is mounted to the internal end of the following pin and engages the biasing element. A scrubbing element is integrated with the attachment end of the tube. When the handle is pressed towards the attachment end, the tube rotates to turn the scrubber element.

In another aspect, the present disclosure provides a container cleaning apparatus comprising an elongated tube member defining a longitudinal axis and a longitudinal length and comprising an internal cavity, an exterior surface, an attachment end portion at a first end of the longitudinal length, a holding end portion at a second end of the longitudinal length, and a helical slot passing from the exterior surface to the internal cavity extending along at least a portion of the longitudinal length and about the longitudinal axis. The apparatus further comprises a handle, and a following pin extending through said helical slot, said following pin having an internal portion positioned within said internal cavity and an external portion engaged with said handle. The apparatus also comprises a biasing element positioned within said internal cavity and engaged with the internal portion of the following pin and the tube member, and a scrubbing element coupled to said attachment end portion such that said scrubbing element and said tube member are rotationally fixed. Longitudinal translation of the handle along the tube member from the handle end portion to the attachment portion rotates the tube member and the scrubbing element about the longitudinal axis in a first rotational direction and biases the biasing element into a first preloaded state.

In some embodiments, the biasing element is a spring. In some embodiments, the biasing element compromises at least two distinct biasing members, and the apparatus further comprises a guide element positioned at least partially between the at least two distinct biasing members. In some such embodiments, the guide element is a guide ball, and the internal cavity is cylindrical.

In some embodiments, the internal portion of the following pin comprises a spherical outer surface. In some embodiments, the scrubbing element comprises a scrubbing portion and a connector, the connector configured to removably couple with the attachment end portion of the tube member. In some embodiments, the scrubbing element comprises a scrubbing portion comprising one of a sponge brush, a rocket brush and a wobbler brush. In some embodiments, the handle comprises an aperture extending therethrough, and the tube member extends into the aperture of the handle.

In some embodiments, user application of a first longitudinal force to the handle acting toward the attachment end portion, and user prevention of rotation of the handle about the longitudinal axis, effectuates the longitudinal translation of the handle along the tube member from the handle end portion to the attachment portion. In some such embodiments, in the first preloaded state, the biasing element applies a second longitudinal force to the handle acting toward the handle end portion. In some such embodiments, when the first longitudinal force is not applied to the handle and the handle is prevented from rotating about the longitudinal axis, the second longitudinal force effectuates longitudinal translation of the handle along the tube member from the attachment end portion to the handle end portion and reduction of at least some of the preload of the biasing element.

In some embodiments, the attachment end portion is void of the helical slot, and the attachment end portion includes at least one aperture that extends from the outer surface to the internal cavity. In some such embodiments, the apparatus further comprises at least one guide element positioned within the internal cavity, and the at least one guide element substantially blocks off the internal cavity. In some such embodiments, longitudinal translation of the handle along the tube member from the handle end portion to the attachment end portion translates the at least one guide element into and along the internal cavity in the attachment end portion of the tube member from in the internal cavity of the handle end portion of the tube member or a medial portion of the of the tube member extending between the handle end portion and the attachment end portion. In some such embodiments, longitudinal translation of the handle along the tube member from the attachment end portion to the handle end portion translates the at least one guide element along the internal cavity in the attachment end portion of the tube member and into at least the medial portion of the of the tube member. In some such embodiments, the biasing element compromises at least a first biasing member and a second member, and wherein the at least one guide element is positioned at least partially longitudinally between the first and second biasing members.

In another aspect, the present disclosure provides a method of cleaning a container. The method comprises inserting an apparatus disclosed herein into the container such that the scrubbing element thereof is positioned against a bottom portion of the container and the handle thereof is positioned at the holding end portion. The method further comprises manually applying a first longitudinal force to the handle acting toward the attachment end portion of the apparatus, while preventing rotation of the handle about the longitudinal axis of the apparatus, to longitudinally translate the handle along the tube member of the apparatus from the handle end portion of the apparatus to the attachment portion to rotate the tube member and the scrubbing element about the longitudinal axis in a first rotational direction and preload a biasing element of the apparatus into a first preloaded state such that the biasing element applies a second longitudinal force to the handle acting toward the handle end portion. The method also comprises, while preventing rotation of the handle about the longitudinal axis, allowing the second longitudinal force to longitudinally translate the handle along the tube member from the attachment end portion to the handle portion to rotate the tube member and the scrubbing element about the longitudinal axis in a second rotational direction that opposes the first rotational direction and release at least a portion of the preload of the first preloaded state of the biasing element.

In some embodiments, the attachment end portion of the apparatus is void of the helical slot and includes at least one aperture that extends from the outer surface to the internal cavity, the apparatus further comprises at least one sealing element positioned within the internal cavity that substantially blocks off the internal cavity, the manually applying the first longitudinal force to the handle longitudinally translates the at least one sealing member in the internal cavity of the attachment end portion toward the at least one aperture to force fluid positioned therein therefrom via the at least one aperture, and the allowing the second longitudinal force to longitudinally translate the handle longitudinally translates the at least one sealing member in the internal cavity of the attachment end portion away from the at least one aperture to draw fluid within the container therein via the at least one aperture.

In another aspect, the present disclosure provides a container cleaning apparatus comprising an elongated tube member defining a longitudinal axis and a longitudinal length and comprising an internal cavity, an exterior surface, an attachment end portion at a first end of the longitudinal length, a holding end portion at a second end of the longitudinal length, and a helical slot passing from the exterior surface to the internal cavity extending along at least a portion of the longitudinal length and about the longitudinal axis. The apparatus further comprises a handle, and a following pin extending through said helical slot, said following pin having an internal portion positioned within said internal cavity and an external portion engaged with said handle. The apparatus also comprises a biasing element positioned within said internal cavity and engaged with the internal portion of the following pin and the tube member, and a scrubbing element coupled to said attachment end portion such that said scrubbing element and said tube member are rotationally fixed. In a first configuration, the handle portion is positioned at the handle end portion and the biasing element exerts a first longitudinal force to the internal portion of the handle member that acts in a direction from the attachment end portion toward the handle end portion. In a second configuration, the handle portion is positioned at the attachment end portion and the biasing element exerts a second longitudinal force to the internal portion of the handle member that acts in a direction from the attachment end portion toward the handle end portion, the second longitudinal force being greater than the first longitudinal force. Reconfiguration between the first and second configurations rotates the tube member and the scrubber element about the longitudinal axis and alters a preload of the biasing element.

In some embodiments, the apparatus further comprises at least one guide element positioned within the internal cavity and engaged with the biasing element, the attachment end portion is void of the helical slot, the attachment end portion includes at least one aperture that extends from the exterior surface to the internal cavity, and, in the second configuration, the at least one guide element is positioned in and seals off the internal cavity in the attachment end portion but for the at least one aperture.

These and other features and advantages of this invention will become apparent from the following detailed description of the various aspects of the invention taken in conjunction with the appended claims and the accompanying drawings.

BRIEF DESCRIPTION OF DRAWINGS

For the purposes of illustrating the invention, the drawings show aspects of one or more embodiments of the invention. However, it should be understood that the present invention is not limited to the precise arrangements and instrumentalities shown in the drawings, wherein.

DETAILED DESCRIPTION

Figure 1:
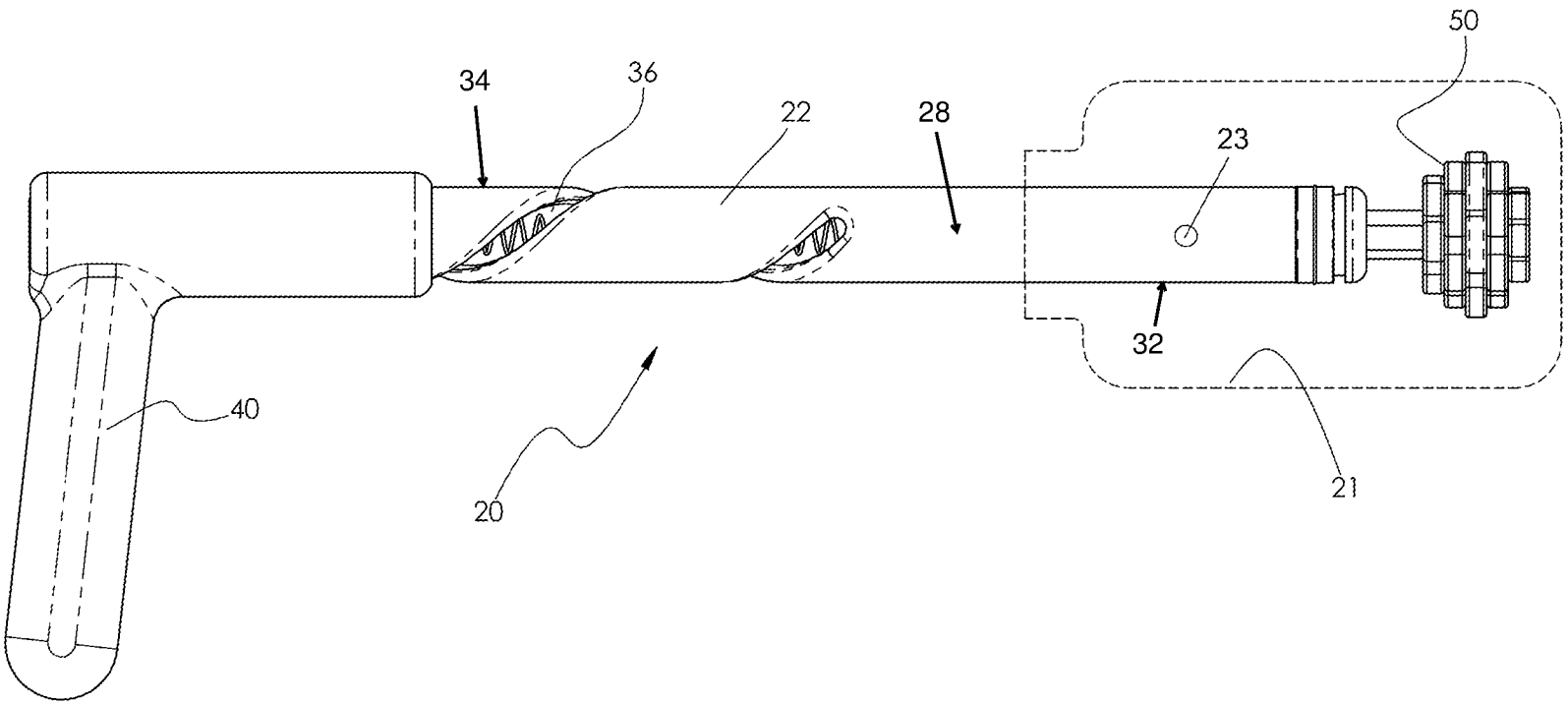
FIG. 1 is a side view of a container cleaning apparatus according to the present disclosure.
Figure 2:
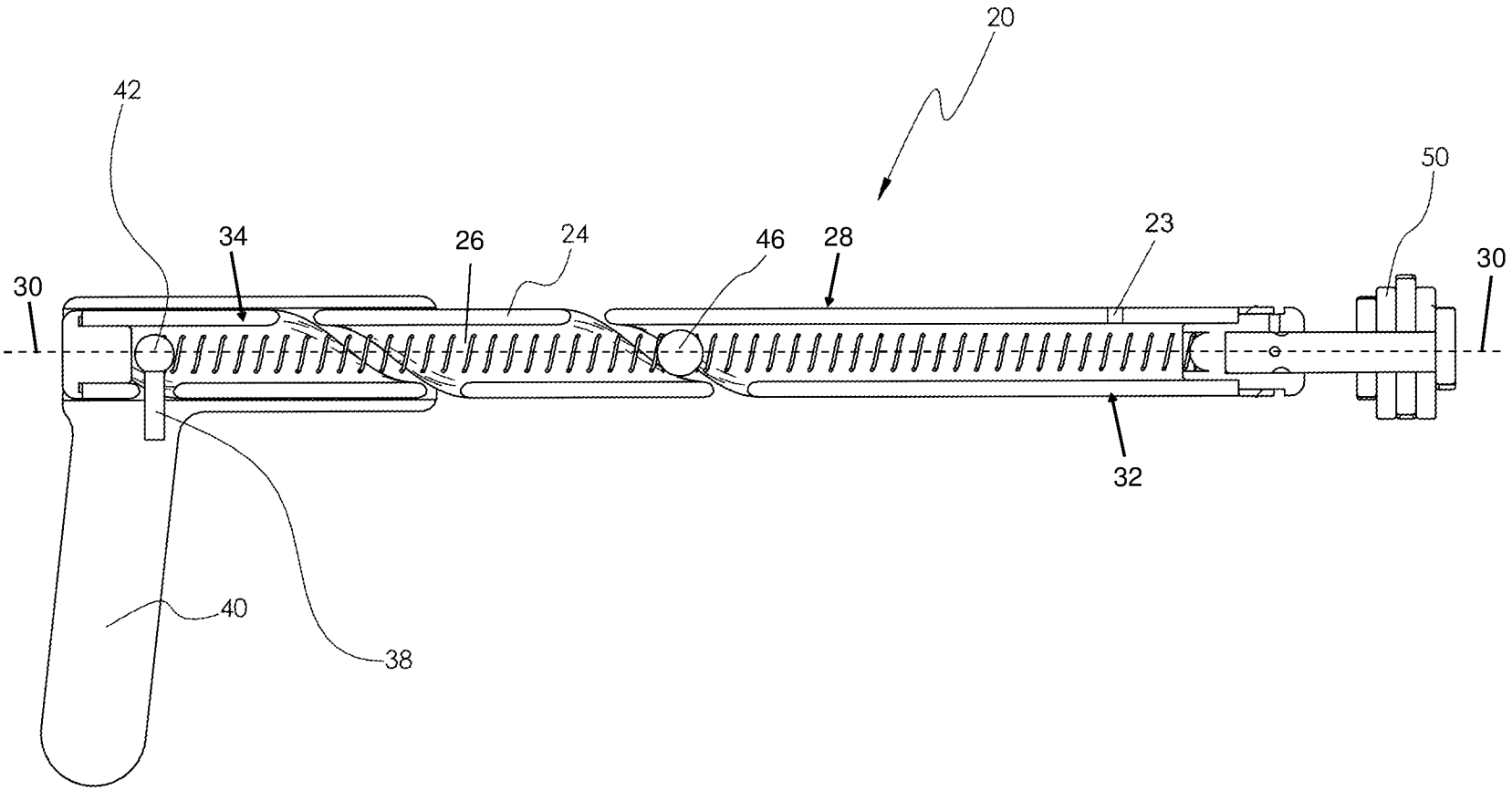
FIG. 2 is a side sectional view of the apparatus shown in FIG. 1.
Figure 3:
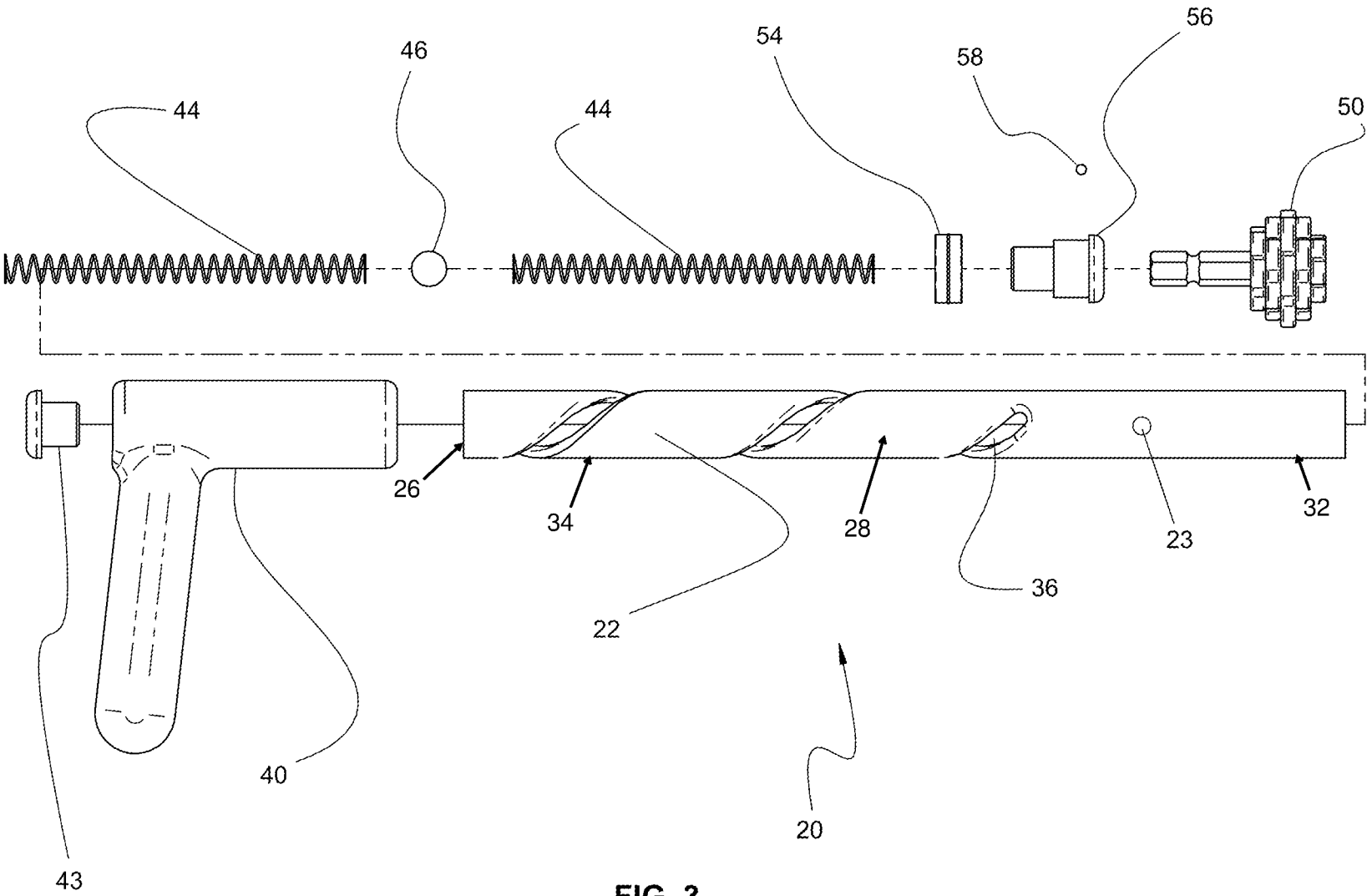
FIG. 3 is an exploded view of the apparatus shown in FIG. 1 illustrating various elements of the apparatus.

Aspects of the present invention and certain features, advantages, and details thereof, are explained more fully below with reference to the non-limiting embodiments illustrated in the accompanying drawings. Descriptions of well-known materials, fabrication tools, processing techniques, etc., are omitted so as to not unnecessarily obscure the invention in detail. It should be understood, however, that the detailed description and the specific example(s), while indicating embodiments of the invention, are given by way of illustration only, and are not by way of limitation. Various substitutions, modifications, additions and/or arrangements within the spirit and/or scope of the underlying inventive concepts will be apparent to those skilled in the art from this disclosure.

An exemplary apparatus, rotary scrubber or container cleaning apparatus 20 according to the present disclosure is illustrated in FIGS. 1-7C. Apparatus 20 may be configured to be used as an apparatus for cleaning containers 21, especially containers 21 having openings that lead to relatively deep containment volumes where it is difficult to clean the sides and/or base of the container.

As shown in FIGS. 1-6B, apparatus 20 comprises a longitudinally-extended elongate tube member 22 having a wall 24 that defines an internal tube cavity or interior 26, a tube exterior surface 28, a longitudinal tube length, a longitudinal tube axis 30, an attachment end portion 32 and a holding end portion 34. Tube member 22 includes a helical slot 36 that passes from the exterior surface 28 to the internal cavity 26. Helical slot 36 runs along a portion of the length of the tube 22, primarily along the holding end portion 34 and a medial portion extending between the holding end portion 34 and the attachment end portion 32. The attachment end portion 32 may thereby be void of the helical slot 36. As explained further below, as shown in FIGS. 1-6B the attachment end portion 32 may be sealed, solid or consistent but for at least one aperture 23 that allows for the intake or suction of fluid into the internal cavity 26 of the attachment end portion 32 from the container 21, and the ejection or forcing out of fluid within the internal cavity 26 of the attachment end portion 32 into the container 21. In this way, the attachment end portion 32 of the apparatus 20 may function as a fluid pump that intakes fluid from the container 21 and sprays one or more jets or streams of fluid into the container 21 to help clean the container 21 during operation of the apparatus, as explained further below. In some embodiments, the at least one aperture 23 extends through the side wall the attachment end portion 32 of the tube member 22 proximate to the scrubber element 50, as shown in FIGS. 1-6B.

While the at least one aperture 23 is depicted in FIGS. 1-6B as extends through the tube member 22 side wall at the attachment end portion 32 (proximate to the scrubber element 50), the at least one aperture 23 may otherwise extend from the end portion of the internal cavity 26 in the attachment end portion 32 proximate to the scrubber element 50. In some other embodiments, the at least one aperture 23 extends through the longitudinal end of the internal cavity 26 and/or tube member 22. For example, the at least one aperture 23 may extend through a lock collar 54, an attachment end plug 56 and/or a lock element 58 positioned in or at (or that defines) the longitudinal end of the internal cavity 26 of the attachment end portion 32 (and thereby the tube member 22 itself). In some other embodiments, the at least one aperture 23 extends through attachment portion of the scrubber element 50.

As shown in FIGS. 2, 4B, 5B and 6B, the apparatus 20 also includes a following pin 38 positioned within or extends through the helical slot 36. Following pin 38 extends from the exterior 28 of tube 22 to the interior cavity 26 of tube 22. Following pin 38 has an external end portion that engages with a handle 40 and an internal end portion that terminates within the cavity 26 as bias engagement element 42, as shown in FIGS. 2, 4B, 5B and 6B.

Handle 40 is designed for easy ergonomic grasping by the user, as shown in FIGS. 1-6B. Although handle 40 is shown extending off to one side of apparatus 20, it is possible to also have a handle 40 that is more or less symmetric with holding end portion 34. Handle 40 may also be off centered or tilt relative to tube axis 30. Additionally, a holding end plug 43 may be used to secure handle 40 to holding end portion 34 and/or plug tube 22. Handle 40 may include an aperture or tube portion that extends therethrough to allow the tube member 22 to extend and longitudinally translate therethrough and rotate therein, as shown in FIGS. 1-6B. In some embodiments, the handle 40 may include an aperture or front and back portions that allow a user to insert their fingers therein/therebetween so as to manually apply a first longitudinal force to the handle 40 acting in a direction toward the attachment end portion 32 from the holding end portion 34, and a second longitudinal force to the handle 40 acting in a direction toward the holding end portion 34 and the attachment end portion 32. The handle 40 may also allow a user to manually grasp the handle 40 to prevent rotation of the handle 40 about the longitudinal axis of the tube member 22.

As shown in FIGS. 1-6B, the apparatus 20 also includes a biasing element or member 44 that resides within tube interior cavity 26. In one embodiment, the biasing element 44 extends from attachment end 32 to the interior end portion of following pin 38 (i.e., the internal portion of the following pin 38 engages biasing element 44). Biasing element 44 may be a spring or any other elastically deformable material or construct. In some embodiments, the interior end portion of following pin 38 may have a spherical surface to better engage biasing element 44, especially if the biasing element is a coiled spring. Additionally, biasing element 44 may be two or more biasing elements with a guide element 46 between adjacent or neighboring biasing elements, as shown in FIGS. 1-6B. A guide element 46 may help to center the biasing element 44 along tube axis 30 and minimize binding of the biasing element 44 as the biasing element 44 expands and contracts. In some embodiments, guide element 46 may be in the shape of a guide ball, and the internal cavity 26 may be cylindrical. In some embodiments, the biasing element 44 may substantially seal, fill or closes off the internal cavity 26. In some embodiments, the apparatus 20 may include a sealing member that substantially seals, fills or closes off the internal cavity 26, and is translated within the internal cavity 26 with/by longitudinal movement of the handle 40.

Figure 6A:
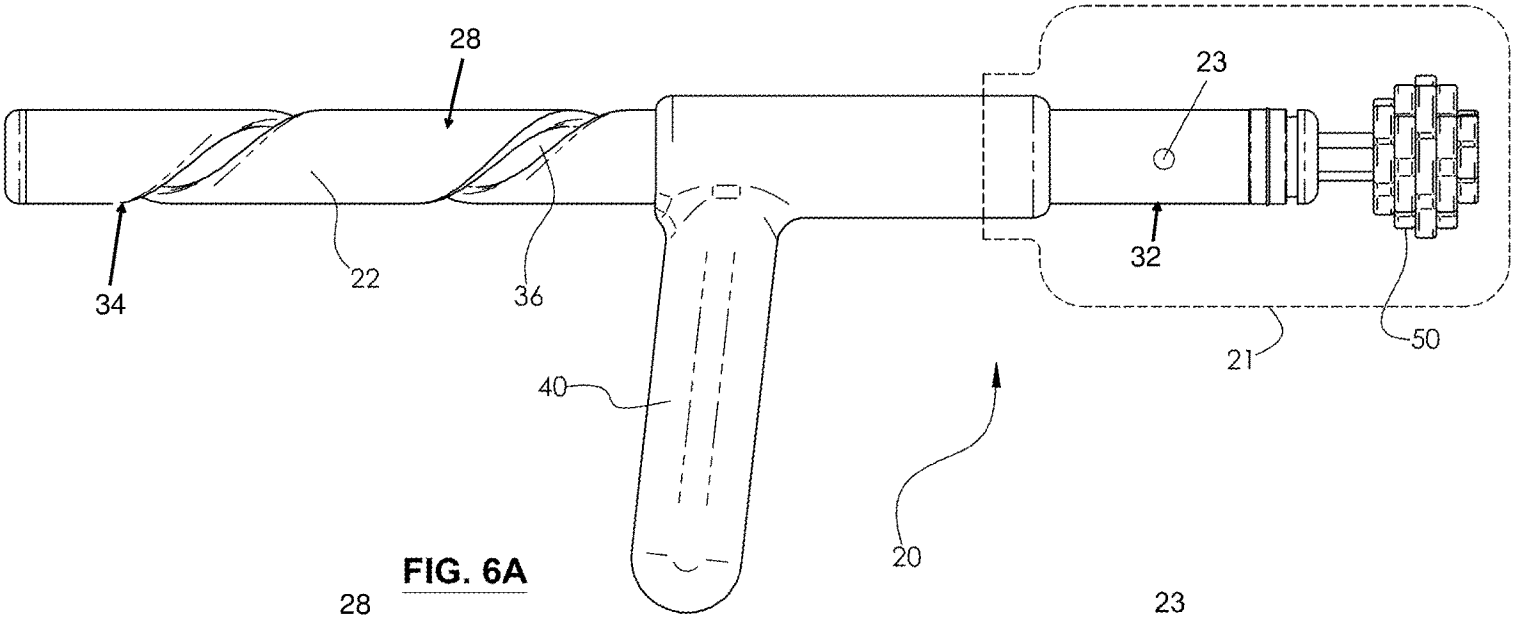
FIG. 6A is a side view of the apparatus shown in FIG. 1 in a third state of use.
Figure 6B:
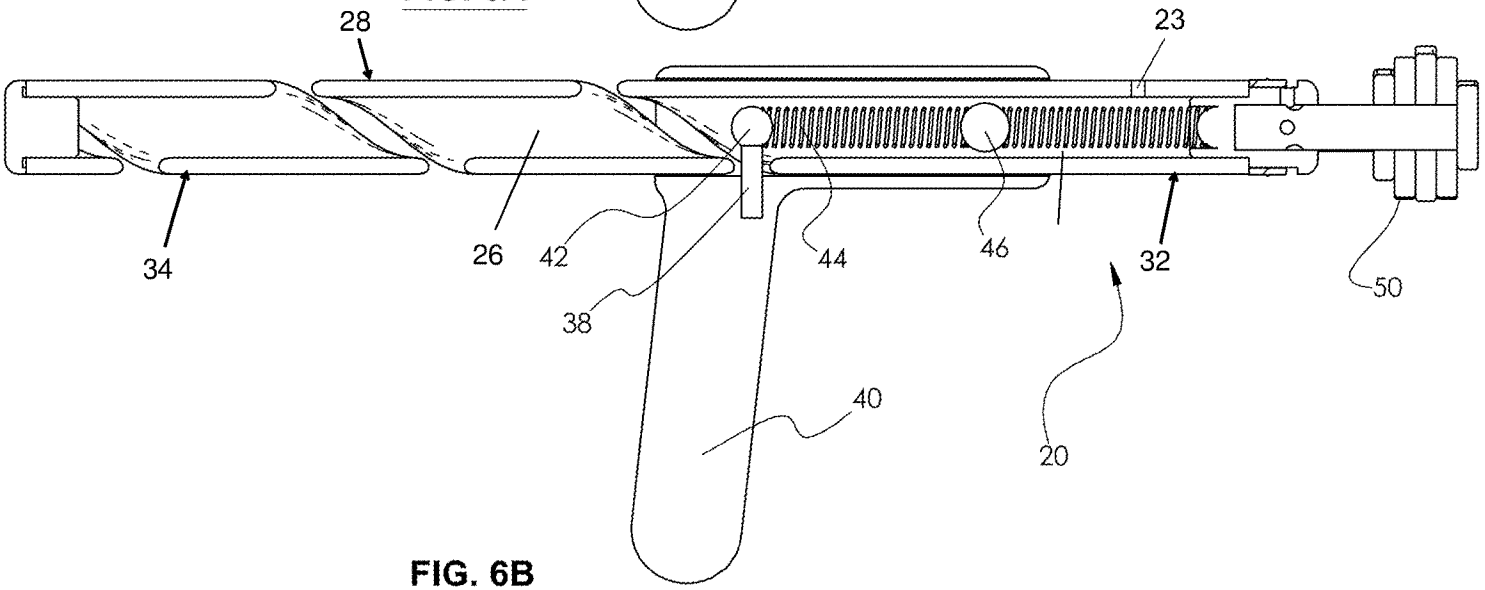
FIG. 6B is a side sectional view of the apparatus shown in FIG. 6A.
Figure 7C:
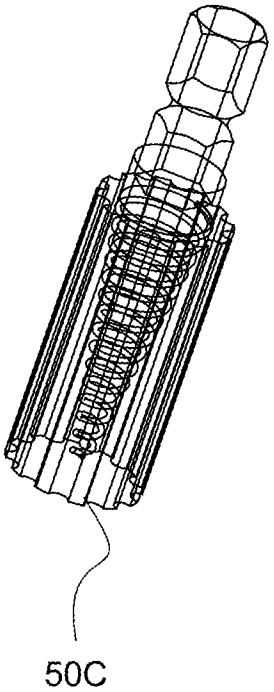
FIG. 7C is a perspective view of one embodiment of another scrubbing element that may be used in conjunction with the apparatus of FIG. 1.
Figure 7B:
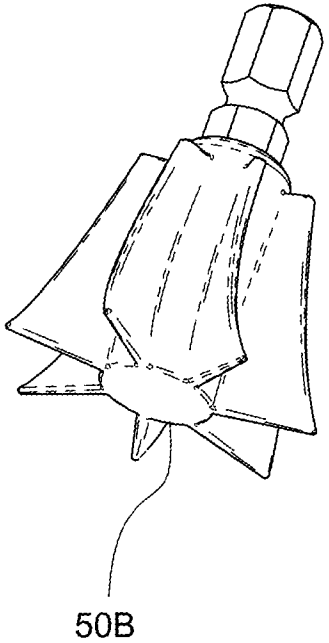
FIG. 7B is a perspective view of one embodiment of another scrubbing element that may be used in conjunction with the apparatus of FIG. 1.
Figure 7A:
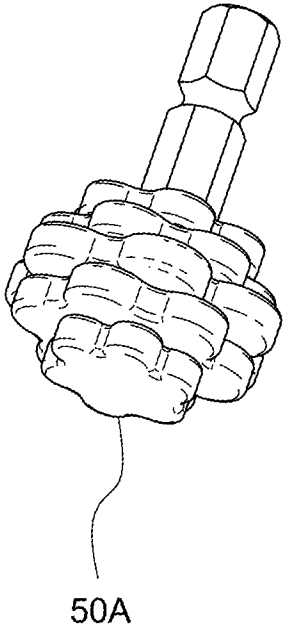
FIG. 7A is a perspective view of one embodiment of a scrubbing element that may be used in conjunction with the apparatus of FIG. 1.

As shown in FIGS. 1-7C, the apparatus 20 may further comprises a scrubbing element 50 integrated or coupled with the attachment end portion 32 of tube member 22. A connector 52 may extend from scrubbing element 50, and may be removably coupled with the attachment end portion 32 to aid in quick release between different types or configurations of scrubbing elements 50. The connector 52 and the attachment end portion 32 of tube member 22 may be configured to removably couple together such that they are rotationally fixed to each other. In some embodiments, connector 52 may include a lock collar 54, an attachment end plug 56 and a lock element 58. FIGS. 7A-7C shows various types of scrubbing elements 50 that may be interfaced with apparatus 20. FIG. 7A is a sponge brush 50*a*, FIG. 7B is a rocket 50*b* and FIG. 7C is a wobbler 50*c*. Each scrubbing element 50*a*-50*c* provides a different cleaning action. Although three types of scrubbing elements 50 are shown (50*a*, 50*b* and 50*c*) it is understood that many more types of scrubbing elements can be attached to apparatus 20.

Figure 4A:
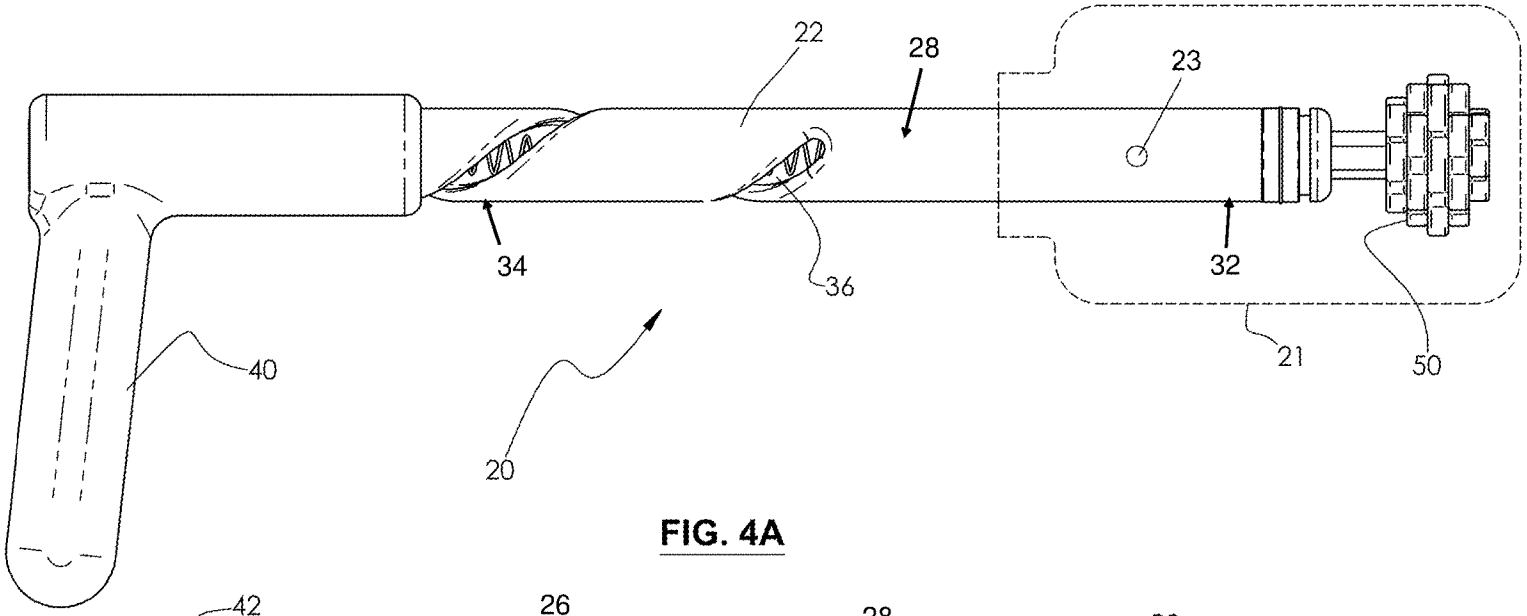
FIG. 4A is a side view of the apparatus shown in FIG. 1 in a first state of use.
Figure 4B:
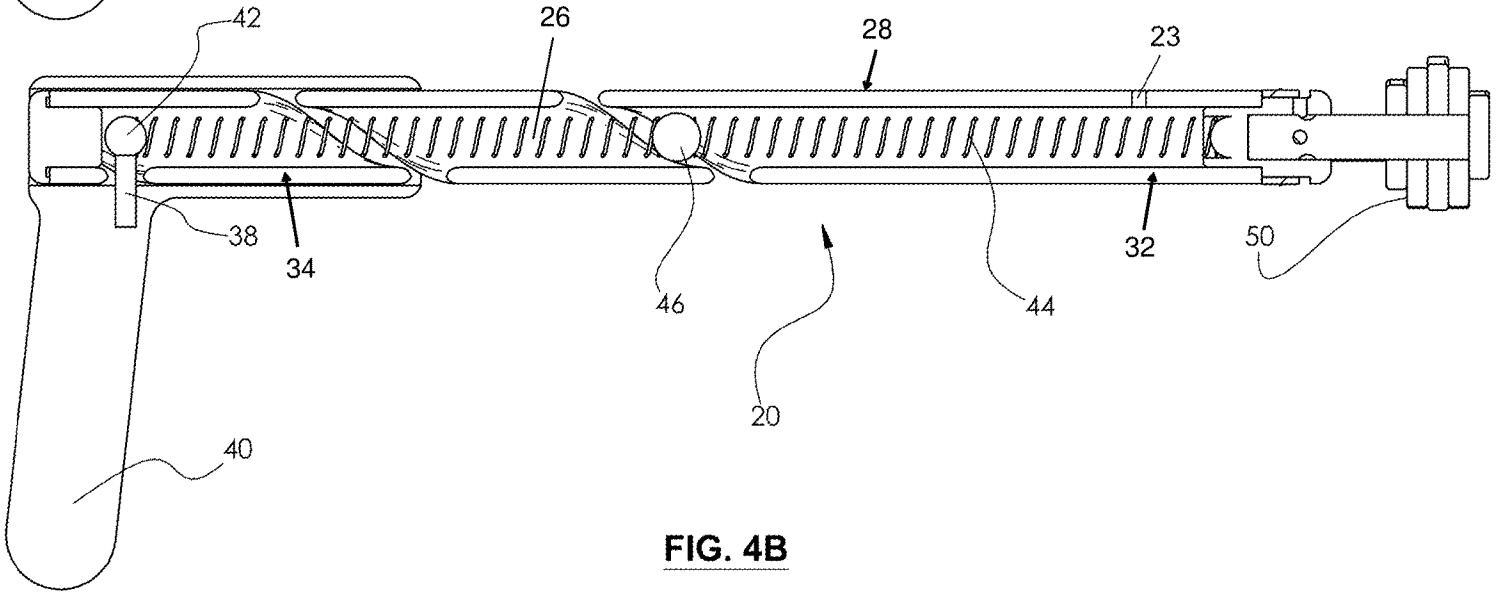
FIG. 4B is a side sectional view of the apparatus shown in FIG. 4A.
Figure 5A:
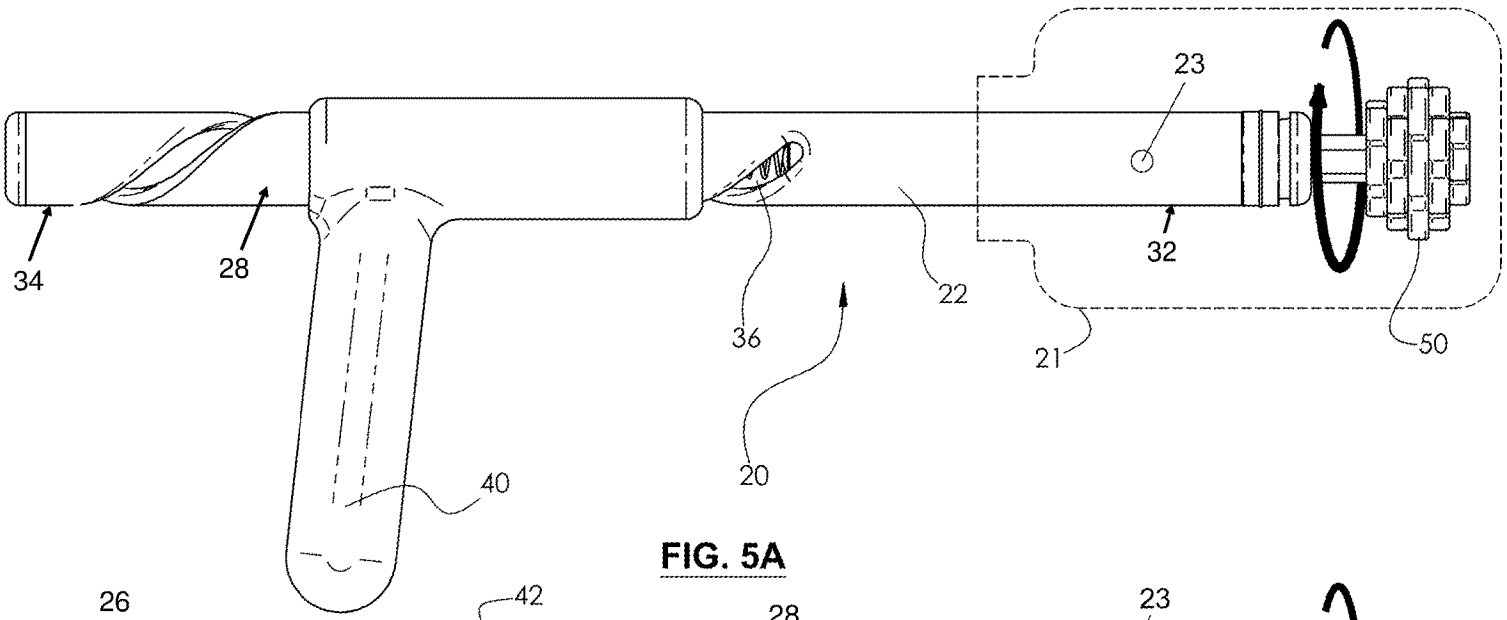
FIG. 5A is a side view of the apparatus shown in FIG. 1 in a second state of use.
Figure 5B:
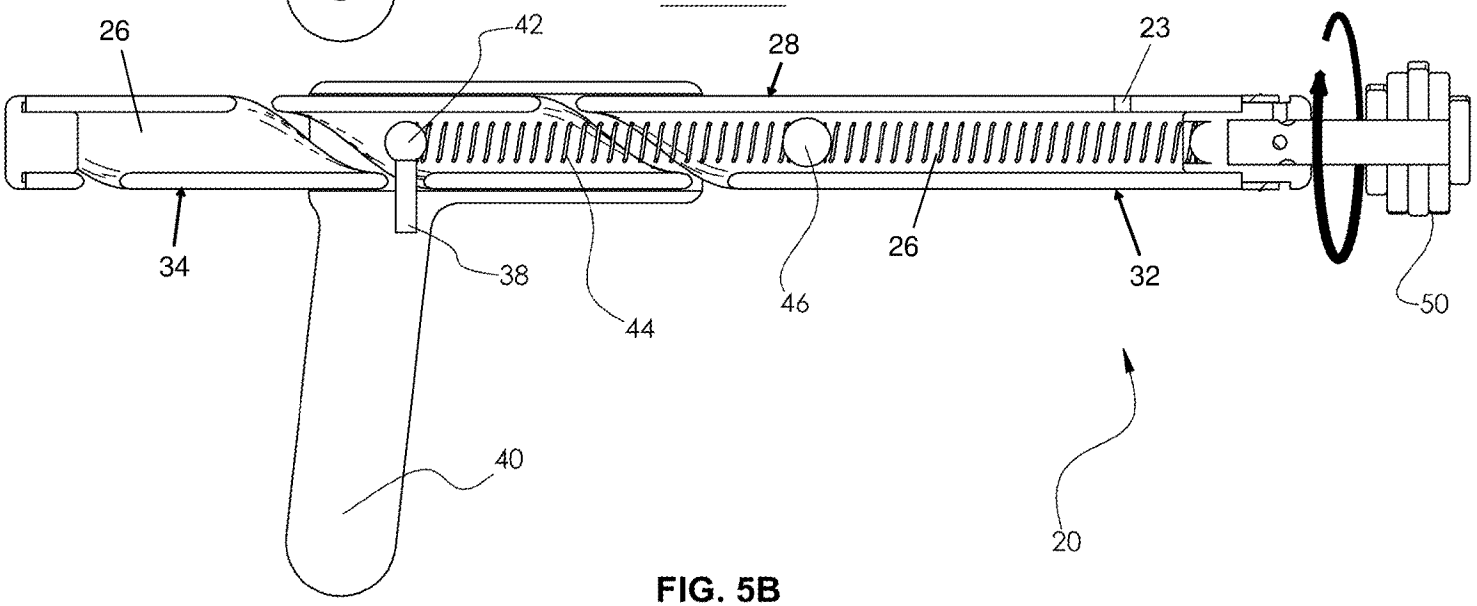
FIG. 5B is a side sectional view of the apparatus shown in FIG. 5A.

Operation of apparatus 20 is shown in FIGS. 4A-6B. FIGS. 4A-4B show a first state of use of apparatus 20. As shown in FIGS. 4A-4B, in the first state the bias element(s) 44 are extended with handle 40 positioned at holding end portion 34. The following pin 38 is within helical slot 36 at or near holding end portion 34. In a second state of use, as shown in FIGS. 5A-5B, handle 40 has been longitudinally forced or pushed towards attachment end portion 32, while being prevented from rotating about the longitudinal axis, with scrubbing element 50 pressing against container 21. The longitudinal force and translation compresses or otherwise preloads biasing element(s) 44, which causes following pin 38 and guide member to travel along helical slot 36. As following pin 38 moves towards attachment end 32 along helical slot 36, and the handle 40 and following pin 38 is prevented form rotating about the tube member 22, the tube member 22 rotates. Rotation of tube member 22 causes scrubbing element 50 to also rotate as the scrubbing element is rotationally fixed to the attachment end portion 32 of the tube 22. This action thereby creates rotation of scrubbing element 50 around tube axis 30 from the linear movement of the user's hand and the handle 40 and following pin 38. Scrubbing element 50 may be further rotated, in third state of use, by pushing handle 40 still further towards attachment end 32 as seen in FIGS. 6A-6B. Upon release of the user's longitudinal force against handle 40, but while the handle 40 is prevented from rotating about the tube member 22, the biasing element(s) 44 expands or otherwise releases the preload and moves the following pin 38 and handle 40 back along helical slot 36 allowing scrubbing element 50 to rotate now in the opposite direction. Therefore, a quick longitudinal push and release action by the user's hand, while preventing the handle 40 and following pin 38 from rotating about the tube member 22, creates back and forth rotation of the scrubbing element 50 within the container 21.

As also shown in FIGS. 4A-6B, in some embodiments the longitudinal travel of the handle 40 and following pin 38 along the tube member 22 may also translate the at least one guide member 46 (and/or another sealing member) into or out of and along the internal cavity 26 of the attachment end portion 32 to form a positive or negative pressure, respectively, therein. For example, longitudinal translation of the handle 40 along the tube member 22 from the holding end portion 34 to the attachment end portion 32 may translate the at least one guide element 46 (and/or another sealing member) into and along the internal cavity 26 in the attachment end portion 32 of the tube member 22 from in the internal cavity 26 of the holding end portion 34 of the tube member 22 or a medial portion of the of the tube member 22 extending between the holding end portion 34 and the attachment end portion 32. When the user manually applies the longitudinal force to the handle 40 to longitudinally translate the at least one guide element 46 (and/or another sealing member) in the internal cavity 26 of the attachment end portion 32 toward the at least one aperture 23, a positive pressure is created, and any force fluid positioned therein is pushed or ejected therefrom via the at least one aperture 23. Such a flow, stream or jet of water may aide in cleaning the container 21. The at least one aperture 23 thereby also prevents pressure buildup and/or blockage of the internal cavity 26 at the attachment end portion 32 from preventing full longitudinal translation of the handle 40 (and the following pin 38 in the helical slot 36), and thereby full stroke or rotation of the scrubber member 50.

Similarly, longitudinal translation of the handle 40 along the tube member 22 from the attachment end portion 32 to the holding end portion 34 may translate the at least one guide element 46 (and/or another sealing member) along the internal cavity 26 in the attachment end portion 32 of the tube member 22 and into at least the medial portion of the of the tube member 22. When the biasing element(s) 44 preloaded force longitudinally translate the handle 40 and the at least one guide element 46 (and/or another sealing member) in the internal cavity 26 of the attachment end portion 32 away from the at least one aperture 23, a negative pressure or suction is created to draw fluid within the container 21 about the attachment end portion 32 therein via the at least one aperture 23. The at least one aperture 23 thereby also prevents suction or sticking of the internal cavity 26 at the attachment end portion 32 from preventing longitudinal translation of the handle 40 (and the following pin 38 in the helical slot 36) away from the attachment end portion 32.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has" and "having"), "include" (and any form of include, such as "includes" and "including"), "contain" (and any form contain, such as "contains" and "containing"), and any other grammatical variant thereof, are open-ended linking verbs. As a result, a method or article that "comprises", "has", "includes" or "contains" one or more steps or elements possesses those one or more steps or elements, but is not limited to possessing only those one or more steps or elements. Likewise, a step of a method or an element of an article that "comprises", "has", "includes" or "contains" one or more features possesses those one or more features, but is not limited to possessing only those one or more features.

As used herein, the terms "comprising," "has," "including," "containing," and other grammatical variants thereof encompass the terms "consisting of" and "consisting essentially of."

The phrase "consisting essentially of" or grammatical variants thereof when used herein are to be taken as specifying the stated features, integers, steps or components but do not preclude the addition of one or more additional features, integers, steps, components or groups thereof but only if the additional features, integers, steps, components or groups thereof do not materially alter the basic and novel characteristics of the claimed compositions or methods.

All publications cited in this specification are herein incorporated by reference as if each individual publication were specifically and individually indicated to be incorporated by reference herein as though fully set forth.

Subject matter incorporated by reference is not considered to be an alternative to any claim limitations, unless otherwise explicitly indicated.

Where one or more ranges are referred to throughout this specification, each range is intended to be a shorthand format for presenting information, where the range is understood to encompass each discrete point within the range as if the same were fully set forth herein.

While several aspects and embodiments of the present invention have been described and depicted herein, alternative aspects and embodiments may be affected by those skilled in the art to accomplish the same objectives. Accordingly, this disclosure and the appended claims are intended to cover all such further and alternative aspects and embodiments as fall within the true spirit and scope of the invention.

What is claimed is:

1. A container cleaning apparatus, comprising:

an elongated tube member defining a longitudinal axis and a longitudinal length and comprising an exterior surface, an attachment end portion at a first end of the longitudinal length, a holding end portion at a second end of the longitudinal length, an internal cavity extending from the first end to the second end and through the attachment end portion and the holding end portion, and a helical slot passing from the exterior surface to the internal cavity extending along at least a portion of the longitudinal length and about the longitudinal axis;

a handle;

a following pin extending through said helical slot, said following pin having an internal portion positioned within said internal cavity and an external portion engaged with said handle;

a biasing element positioned within said internal cavity and engaged with the internal portion of the following pin and the tube member; and a scrubbing element coupled to said attachment end portion such that said scrubbing element and said tube member are rotationally fixed, wherein longitudinal translation of the handle along the tube member from the holding end portion to the attachment end portion rotates the tube member and the scrubbing element about the longitudinal axis in a first rotational direction and biases the biasing element into a first preloaded state, and wherein the attachment end portion is void of the helical slot and includes at least one open aperture that extends between an inner surface of the tube member that defines the internal cavity and the exterior surface of the tube member that forms at least one unobstructed passageway extending between the internal cavity and the exterior surface.

2. The apparatus of claim 1, wherein the biasing element is a spring.

3. The apparatus of claim 1, wherein the biasing element comprises at least two distinct biasing members, and further comprising a guide element positioned at least partially between the at least two distinct biasing members.

4. The apparatus of claim 3, wherein the guide element is a guide ball, and wherein the internal cavity is cylindrical.

5. The apparatus of claim 1, wherein the internal portion of the following pin comprises a spherical outer surface.

6. The apparatus of claim 1, wherein the scrubbing element comprises a scrubbing portion and a connector, the connector configured to removably couple with the attachment end portion of the tube member.

7. The apparatus of claim 1, wherein the scrubbing element comprises a scrubbing portion comprising one of a sponge brush, a rocket brush and a wobbler brush.

8. The apparatus of claim 1, wherein the handle comprises an aperture extending therethrough, and wherein the tube member extends into the aperture of the handle.

9. The apparatus of claim 1, wherein user application of a first longitudinal force to the handle acting toward the attachment end portion, and user prevention of rotation of the handle about the longitudinal axis, effectuates the longitudinal translation of the handle along the tube member from the holding end portion to the attachment end portion.

10. The apparatus of claim 9, wherein, in the first preloaded state, the biasing element applies a second longitudinal force to the handle acting toward the holding end portion.

11. The apparatus of claim 10, wherein, when the first longitudinal force is not applied to the handle and the handle is prevented from rotating about the longitudinal axis, the second longitudinal force effectuates longitudinal translation of the handle along the tube member from the attachment end portion to the holding end portion.

12. The apparatus of claim 1, further comprising at least one guide element positioned within the internal cavity, wherein the longitudinal translation of the handle along the tube member from the holding end portion to the attachment end portion translates the at least one guide element along the internal cavity and into at least a portion of the attachment end portion, and wherein, when positioned in the attachment end portion, the at least one guide element substantially seals off the internal cavity in the attachment end portion but for the at least one aperture.

13. The apparatus of claim 12, wherein longitudinal translation of the handle along the tube member from the holding end portion to the attachment end portion translates the at least one guide element along the internal cavity and into the attachment end portion of the tube member from the holding end portion of the tube member or a medial portion of the tube member extending between the holding end portion and the attachment end portion.

14. The apparatus of claim 13, wherein longitudinal translation of the handle along the tube member from the attachment end portion to the holding end portion translates the at least one guide element along the internal cavity in the attachment end portion of the tube member and into at least the medial portion of the tube member.

15. The apparatus of claim 14, wherein the biasing element comprises at least a first biasing member and a second member, and wherein the at least one guide element is positioned at least partially longitudinally between the first and second biasing members.

16. A container cleaning apparatus, comprising: an elongated tube member defining a longitudinal axis and a longitudinal length and comprising an exterior surface, an attachment end portion at a first end of the longitudinal length, a holding end portion at a second end of the longitudinal length, an internal cavity extending from the first end to the second end and through the attachment end portion and the holding end portion, and a helical slot passing from the exterior surface to the internal cavity extending along at least a portion of the longitudinal length and about the longitudinal axis;

a handle;

a following pin extending through said helical slot, said following pin having an internal portion positioned within said internal cavity and an external portion engaged with said handle;

a biasing element positioned within said internal cavity and engaged with the internal portion of the following pin and the tube member; and a scrubbing element coupled to said attachment end portion such that said scrubbing element and said tube member are rotationally fixed, wherein in a first configuration the handle is positioned at the holding end portion and the biasing element exerts a first longitudinal force to the internal portion that acts in a direction from the attachment end portion toward the holding end portion, wherein in a second configuration the handle is positioned at the attachment end portion and the biasing element exerts a second longitudinal force to the internal portion that acts in a direction from the attachment end portion toward the holding end portion, the second longitudinal force being greater than the first longitudinal force, wherein reconfiguration between the first and second configurations rotates the tube member and the scrubbing element about the longitudinal axis, and wherein the attachment end portion is void of the helical slot and includes at least one open aperture that extends between an inner surface of the tube member that defines the internal cavity and the exterior surface of the tube member that forms at least one unobstructed passageway extending between the internal cavity and the exterior surface.

17. The apparatus of claim 16, further comprising at least one guide element positioned within the internal cavity and engaged with the biasing element, wherein the attachment end portion is void of the helical slot, wherein the reconfiguration between the first and second configurations translates the at least one guide element along the internal cavity and into at least a portion of the attachment end portion, and wherein, when positioned in the attachment end portion, the at least one guide element seals off the internal cavity in the attachment end portion but for the at least one aperture.

* * * * *